US006902037B2

(12) United States Patent
Salvarezza

(10) Patent No.: US 6,902,037 B2
(45) Date of Patent: Jun. 7, 2005

(54) DEVICE FOR SECURING ROPE LADDER STEPS

(75) Inventor: Robert M. Salvarezza, Hillsborough, CA (US)

(73) Assignee: Coast Marine & Industrial Supply, Inc., San Francisco, CA (US)

( * ) Notice: Subject to any disclaimer, the term of this patent is extended or adjusted under 35 U.S.C. 154(b) by 0 days.

(21) Appl. No.: 10/653,839

(22) Filed: Sep. 2, 2003

(65) Prior Publication Data

US 2005/0045424 A1 Mar. 3, 2005

(51) Int. Cl.[7] ..... E06C 1/52
(52) U.S. Cl. ..... 182/196; 182/197; 182/228
(58) Field of Search ..... 182/196, 46, 70, 182/73, 75, 197, 198, 199, 228, 72

(56) References Cited

U.S. PATENT DOCUMENTS 4,177,878 A 12/1979 Salvarezza
4,184,784 A * 1/1980 Killian ..... 403/267
4,241,809 A 12/1980 Salvarezza
4,554,996 A 11/1985 Salvarezza
4,655,321 A 4/1987 Salvarezza
4,683,981 A 8/1987 Salvarezza
5,735,628 A * 4/1998 Short ..... 403/218
2004/0094363 A1 * 5/2004 Bagshaw ..... 182/196

FOREIGN PATENT DOCUMENTS

JP 409031877 A * 2/1997 ..... 182 196 X

* cited by examiner

*Primary Examiner*—Bruce A. Lev
(74) *Attorney, Agent, or Firm*—Bingham McCutchen LLP

(57) ABSTRACT

This invention is directed to a device for securing a step of a rope ladder to the rope. The device includes an upper and a lower wedge collar, each of which has a central slot through which the ropes to be secured are threaded. The device further includes a diamond-shaped wedge heart which is inserted in the slot between the ropes such that the ropes are compressed between the sides of the wedge collars and the edges of the wedge heart. The wedge heart also has locking lugs on each edge, each locking lug contacting a surface of the upper and the lower wedge collar to prevent the wedge heart from being pulled through the slot in the wedge collars when pressure is applied to the ropes.

12 Claims, 6 Drawing Sheets

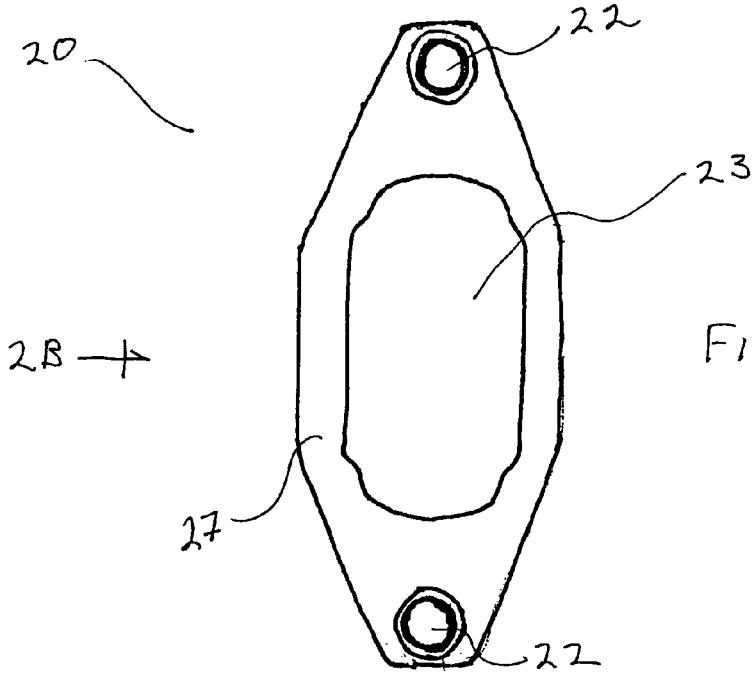
Figure 2A
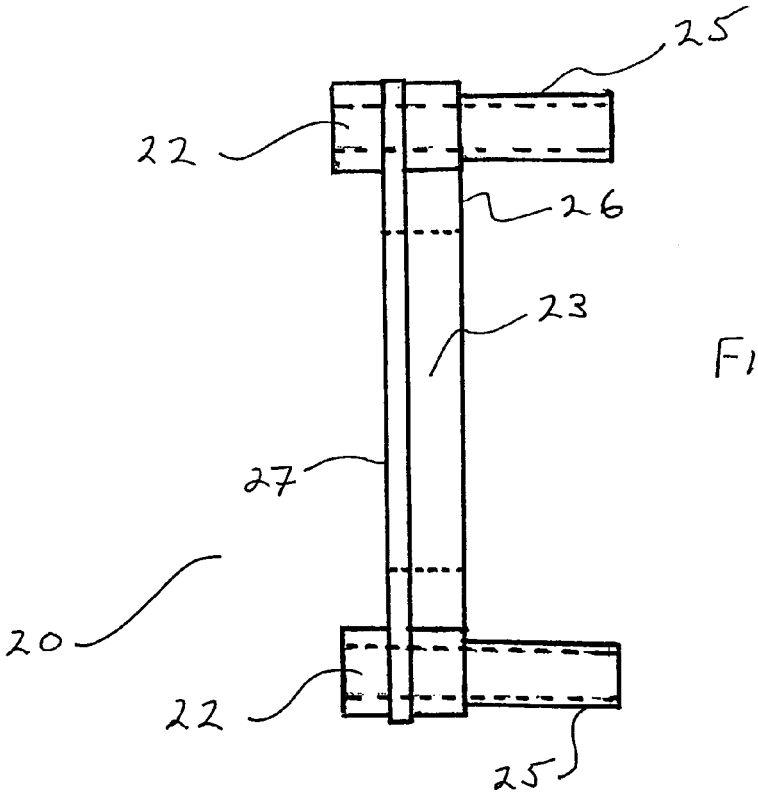
Figure 2B
Figure 2

DEVICE FOR SECURING ROPE LADDER STEPS

FIELD OF THE INVENTION

The present invention relates to rope ladders. More specifically, it relates to a device and method of securing steps to the ropes of rope ladders such that the steps have superior resistance to rope slippage.

BACKGROUND OF THE INVENTION

The following is provided as background only; nothing in this section is intended to be, nor should any of it be construed as, prior art to the present invention.

Rope ladders have many uses. For example, they serve as emergency escape means from buildings and other structures. They also are used as boarding and disembarking means for ships at sea, in particular by local pilots who board ships coming into harbor to assume responsibility for docking them. To reduce any contribution of the rope ladders themselves to the substantial risks involved when using them to embark or disembark a ship, the Coast Guard has mandated rigid specifications to which marine-use rope ladders must adhere. To this end, a number of patents have been issued relating to rope ladders, in particular to the steps of the ladders and to the means by which the steps are secured to the ropes.

One of the earliest patents relating to rope ladders as modernly conceived is U.S. Pat. No. 4,177,878, to Salvarezza, filed 14 Aug. 1978, issued 11 Dec. 1979. Originally, the steps used for rope ladders were made of wood and were susceptible to warping, breakage and general structural non-uniformity. The advent of superior strength polymers led to the development and use of steps made of hard, tough, durable polymeric materials. Thus, U.S. Pat. No. 4,241,809 to Salvarezza, filed 13 Aug. 1979 and issued Dec. 30, 1980, also to Salvarezza, is directed to a rope ladder with a molded hard elastomer step and a method for assembling ladders using such steps. Another patent, U.S. Pat. No. 4,554,996, likewise to Salvarezza, filed 12 Apr. 1985, issued 26 Nov. 1985, is directed to additional features of molded hard elastomer rope ladder steps as well as to replacement steps and collars. U.S. Pat. No. 4,655,321, again to Salvarezza, filed 29 Aug. 1986 and Issued Apr. 7, 1987, adds to the art an improved method for assembling rope ladders comprising molded hard elastomer steps and U.S. Pat. No. 4,683,981, to Salvarezza, is directed to molded hard elastomer steps having additional features, to replacement and spreader steps and to novel methods of molding the steps. Each of the preceding patents is incorporated by reference, including all drawings, as if fully set forth herein.

While the means for securing the steps to ropes in the above patents surpass all Coast Guard specifications with regard to load-bearing without rope slippage, even greater non-slippage capability, and therefore an even greater margin of safety, is always desirable. The present invention provides a means for securing ropes to the steps of rope ladders that renders the likelihood of slippage of the steps along the rope vanishingly small under virtually any load.

SUMMARY OF THE INVENTION

Thus, in one aspect, the present invention relates to a device for securing ropes to steps of a rope ladder, comprising:

a upper wedge-collar comprising:
- a top surface having a length and a width;
- a bottom surface substantially parallel to the top surface, having a length and a width substantially the same as the top surface, the top surface being coupled to the bottom surface by an edge surface;
- an elongate slot extending through the upper wedge-collar from the top surface to the bottom surface, the slot being defined by two side-walls and two end walls, wherein:
  - the side walls and end walls are perpendicular to the top and bottom surfaces;
  - the side walls are substantially straight;
  - the end walls are curved, wherein the curve may be simple or complex;
- at least two fastener bores extending through the wedge-collar from the top surface to the bottom surface;
- at least two fastener bore extensions, one for each fastener bore, coupled to the bottom surface such that a lumen through each extension aligns with each fastener bore;

a lower wedge-collar comprising:
- a top surface having a length and a width;
- a bottom surface substantially parallel to the top surface having a length and width substantially the same as the top surface, the top surface being coupled to the bottom surface by an edge surface;
- an elongate slot extending through the lower wedge-collar from the top surface to the bottom surface, the slot being defined by two sidewalls and two end-walls, wherein:
  - the side walls are perpendicular to the top and bottom surfaces;
  - the end-walls are rounded and inwardly tapered from the top surface to the bottom surface such that the slot is larger at the top surface than it is at the bottom surface; and, a wedge-heart comprising:
- a diamond-shaped first surface having an upper vertex, a lower vertex and two transverse vertices; and,
- a diamond-shaped second surface parallel to the first surface, the second surface being of substantially the same size and shape as the first surface and likewise having an upper vertex, a lower vertex and two transverse vertices, wherein:
  - the second surface is coupled to the first surface by a concave edge surface comprising a first edge-rim and a second edge-rim, each of which extends the entire perimeter of the edge surface, wherein:
  - each edge-rim comprises two locking lugs, one located substantially at each transverse vertex, wherein:
    - the upper wedge-collar, the wedge-heart and the lower wedge collar are operationally coupled to one another.

In an aspect of this invention, the end-walls of the lower wedge-collar comprise raised ribs substantially parallel to the top and bottom surfaces.

In an aspect of this invention, the edge-surface of the wedge-heart comprises raised ribs substantially perpendicular to the first and second surfaces of the wedge-heart.

In an aspect of this invention, the end-walls of the lower wedge-collar comprise raised ribs substantially parallel to the top and bottom surfaces and the edge-surface of the wedge-heart comprises raised ribs substantially perpendicular to the first and second surfaces of the wedge-heart.

In an aspect of this invention, the upper wedge-collar, the lower wedge-collar and the wedge-heart are separate units.

In an aspect of this invention, the upper wedge-collar, the lower wedge-collar and the wedge-heart each comprise a polymer, which may be the same as, or different from, the polymer of each of the others.

In an aspect of this invention, the upper wedge-collar, the lower wedge-collar and the wedge-heart comprise the same polymer.

In an aspect of this invention, polymer comprises a hard, tough moldable polymer.

In an aspect of this invention, the polymer is nylon.

In an aspect of this invention, the upper wedge collar is an integral part of a molded polymeric step and the lower surface of the upper wedge-collar and the fastener bore extensions do not exist.

An aspect of this invention is a rope ladder step comprising the device of claim 1.

An aspect of this invention is a rope ladder comprising a plurality of the rope ladder steps of claim 11.

DETAILED DESCRIPTION OF THE INVENTION

Brief Description of the Figures

FIG. 2 is a representation of an upper wedge-collar. FIG. 2A is a depiction of the upper wedge collar as it appears from a top perspective. FIG. 2B is a depiction of the upper wedge collar as it appears from a side perspective.

FIG. 3A is a depiction of the lower wedge collar as it appears from a top surface perspective. FIG. 3B is a depiction of the lower wedge-collar as it appears from a side perspective as indicated by the arrow numbered "3B. " FIG. 3C is a depiction of the lower wedge collar as it appears from a bottom surface perspective.

FIG. 4A is a depiction of the wedge-heart as it appears from a side perspective. FIG. 4B is a depiction of the wedge-heart as it appears from an end perspective indicated by the arrow numbered "4B. " in FIG. 4A. FIG. 4C is a depiction of the wedge-heart as it appears from a top perspective indicated by the arrow numbered "4C" in FIG. 4A. FIG. 4D is a depiction of the wedge-heart as viewed from an oblique perspective.

DISCUSSION

As used herein, the term "substantially" means that, to one skilled in the art, the feature so-modified is, in its structurally important features, as described. Thus, for example, when it is stated that a side wall is "substantially" straight, what is meant is that the wall may have some small degree of curvature but, to one skilled in the art observing the wall in view of the claims and the function of the wall, would see the wall could be described as straight. Likewise, "substantially parallel" surfaces may have features that protrude from the surfaces but, to one skilled in the art, it would be apparent that the surfaces are, in a structural sense, parallel.

As used herein, the term "simple curve" means a curved feature having a single radius of curvature and a "complex curve" means a curved surface having two or more radii of curvature.

Figure 1:
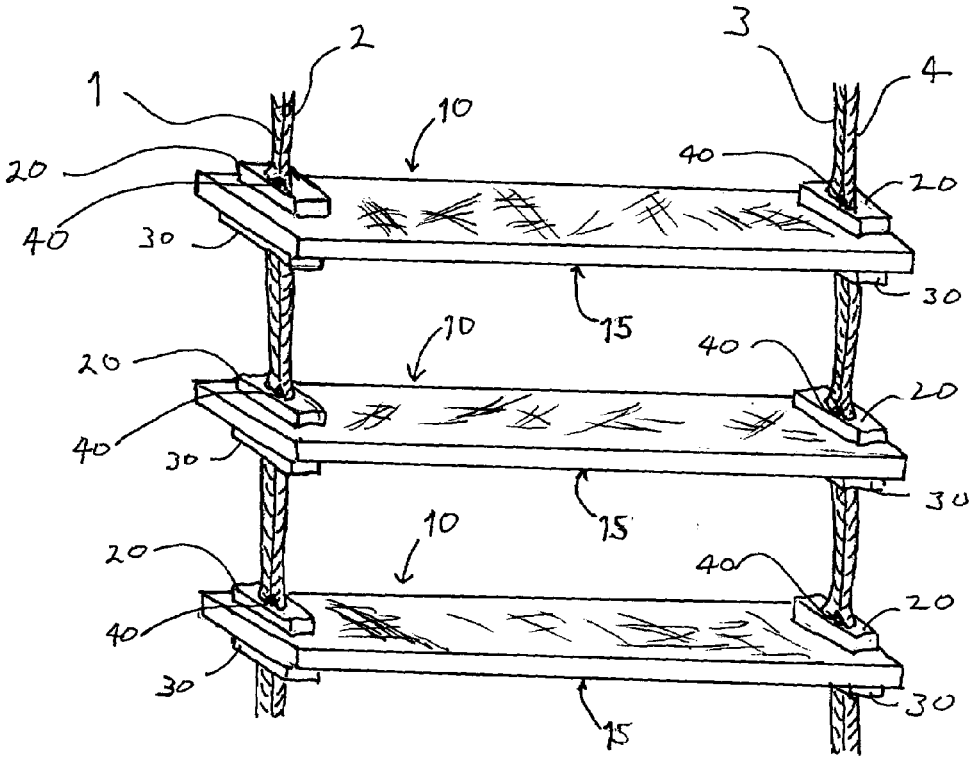
FIG. 1 is a representation of a section of a rope ladder of this invention.

FIG. 1 shows a schematic representation of a portion of a rope ladder of this invention. Two sets of ropes 1 and 2 and 3 and 4 are disposed at either end of steps 10. The ropes are secured to the steps by means of upper wedge collars 20, lower wedge collars 30 and wedge-hearts 40. It is, of course, understood that the three steps shown in FIG. 1 are for illustrative purposes only and that an actual rope ladder would consist of many more such steps, each of which is secured to the ropes in the same manner.

Figure 6:
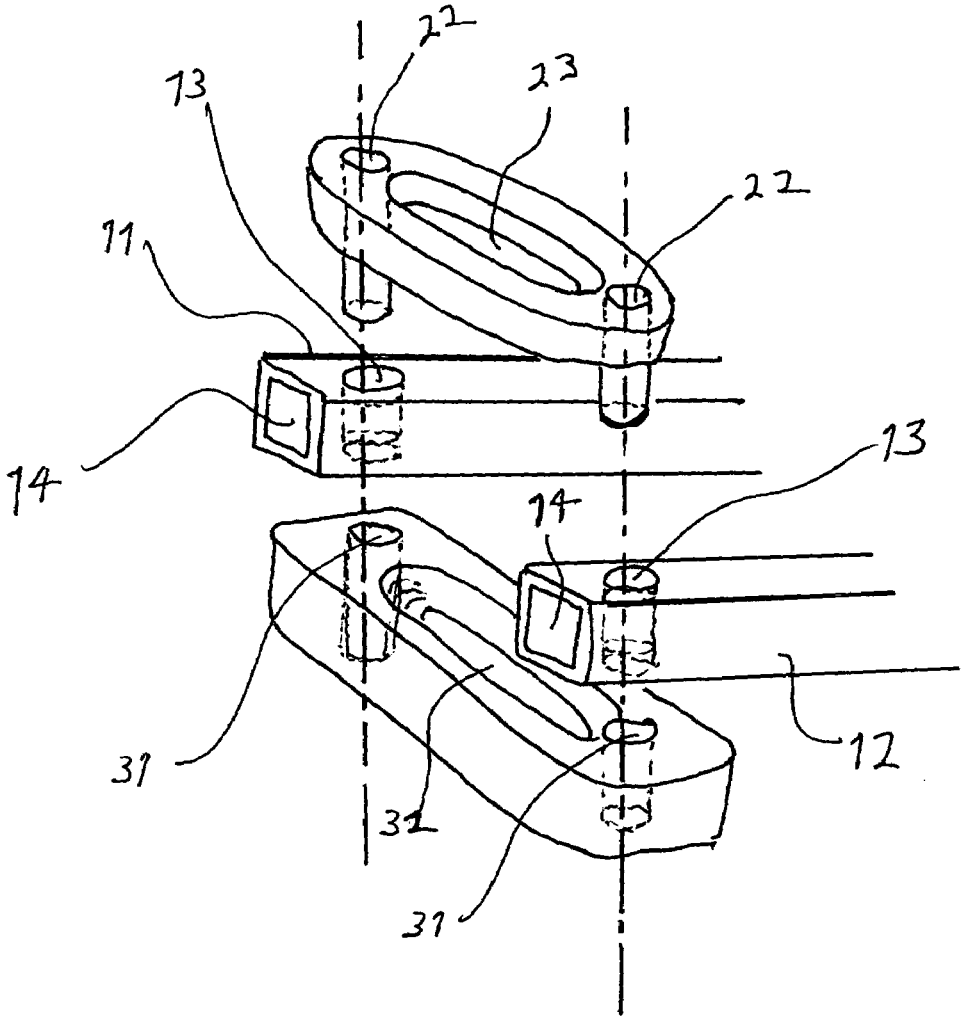
FIG. 6 is a representation of the relationship between an upper wedge-collar, the structural scaffold members of a step and a lower wedge-collar before ropes are inserted through the slots of the wedge-collars and before a wedge-heart is inserted between the ropes. The figure also shows how a step of this invention is held together once assembled; i.e., by a fastener that is passed through fastener bores 22, 13 and 31.

FIG. 2 is a schematic representation of upper wedge-collars 20. Upper wedge-collars 20 are made of a hard, tough resilient material such as, without limitation, wood, metal or plastic. Hard, tough, resilient moldable polymers such as nylon are presently preferred. Upper wedge-collars 20 have fastener bores 22 at either end through which fastening means such as, without limitation, screws, rivets or, in a presently preferred embodiment of this invention, bolts, are inserted to secure upper wedge-collars 20 and lower wedge collars 30 to steps 10 as shown in FIG. 6. In addition, upper wedge collars 20 have a slot 23 through which the ropes of the rope ladder pass. Another feature of upper wedge-collars 20 is fastener bore extensions 25. Extensions 25 are made of non-conductive material, preferably the same hard polymeric material as the rest of upper wedge-collars 20 so that extensions 25 can be molded as integral parts of the upper wedge collars. Extensions 25 pass through holes 13 (FIG. 6) in the steps so that, if the portion of the step through which a fastening means will extend is made of metal, as in the case, without limitation of a step constructed of a metal frame to which a polymeric step surface has been molded, the metal of the hole in the step that aligns with the fastener bores in the wedge-collars will not contact the fasteners, which preferably are made of metal such as, without limitation, stainless steel, when they are inserted into the fastener bore. In this manner, electrolysis resulting from metal on dissimilar metal contact and the attendant corrosion of the step and/or the fastener, in particular under the influence of salt water in a marine-use environment, is avoided.

Figure 3:
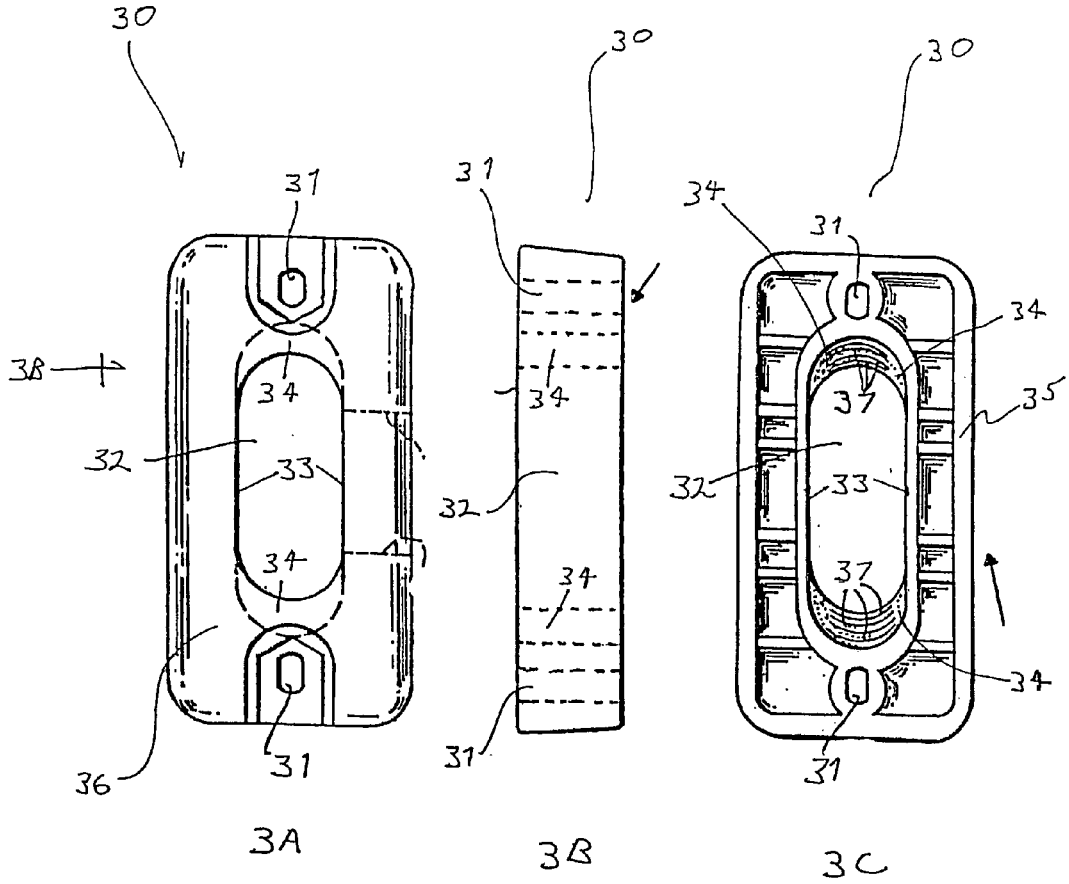
FIG. 3 is a representation of a lower wedge-collar of this invention.

FIG. 3 is a schematic of lower wedge-collars 30. Lower wedge-collars 30 are also made of a hard, tough resilient material such as, without limitation, wood, metal or plastic. Hard, tough, resilient moldable polymers such as nylon are presently preferred. Lower wedge-collars 30 also comprise two fastener bores 31 at either end. When a step is assembled, fastener bores 22 align with fastener bores 31 (and the corresponding holes in the step, FIG. 6) so that a fastener can be passed through all three elements, upper wedge-collar 20, step 10 and lower wedge-collar 30. Lower wedge-collar 30 also comprises a slot 32, which has substantially straight, vertical side-walls 33 and tapered, curved end walls 34. In use, top surface 35 of lower wedge-collar 30 is in contact with underside surface 15 of step 10 such that, due to the taper in the end-wall surfaces, slot 31 is larger at the point of contact of the wedge-collar with the step than it is at bottom surface 36 of lower-wedge-collar 30, which surface is furthest from underside surface 15 of the step. Curved surface 34 of lower wedge-collar 30 optionally also has generally horizontal (i.e., substantially parallel to the top and bottom surfaces 35 and 36) raised protrusions or ribs 37, which serve to increase the frictional force on ropes passed through slot 32 when a step is being secured to the ropes.

Figure 4:
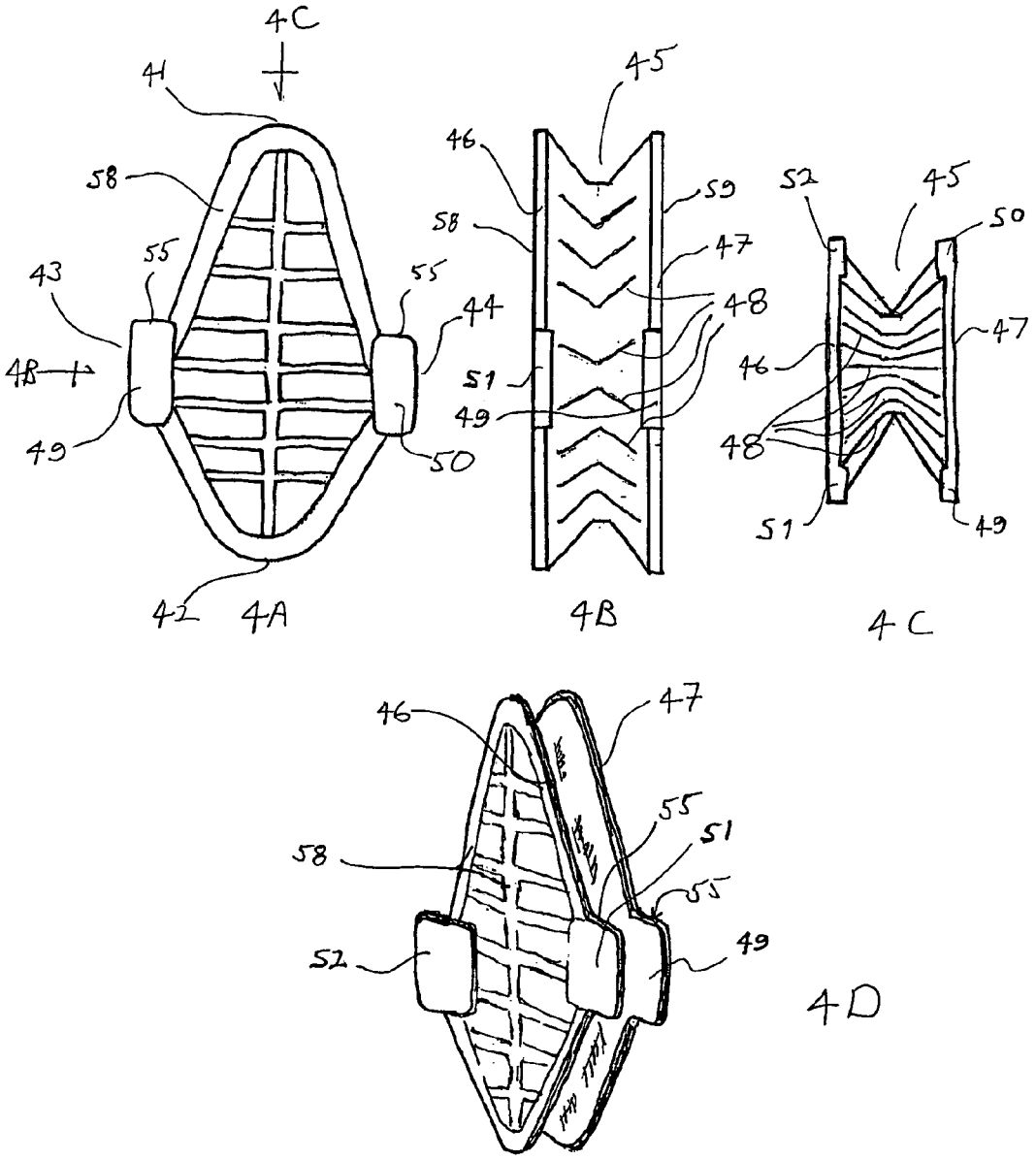
FIG. 4 is a representation of a wedge-heart of this invention showing the novel locking lugs.

FIG. 4 is a schematic representation of wedge-heart 40. Wedge-heart 40 is also are made of a hard, tough resilient material such as, without limitation, wood, metal or plastic. Hard, tough, resilient moldable polymers such as nylon are presently preferred. Wedge-heart 40 comprises two parallel, generally diamond-shaped surfaces 58 and 59, each having an upper long apex 41 and a lower long apex 42 and transverse short apices 43 and 44. Wedge-heart 40 also has a concave edge surface 45 that serves as a rope guide when the wedge-heart is in use, The concave edge surface or rope guide extends the entire perimeter of wedge-heart 40 and comprises edge-rims 46 and 47 that likewise extend the entire perimeter of wedge-heart 40. Groove/concave edge surface/rope guide 45 may be smooth or textured. In a presently preferred embodiment, rope guide 45 has substantially horizontal (i.e., perpendicular to the first and second surfaces, 58 and 59) raised protrusions or ribs 48 along its entire length. The number of ribs shown in FIG. 4 is illustrative only and is not intended to depict the number of such ribs on an actual wedge-heart nor is it intended, or is it to be construed, to limit the scope of this invention in any manner whatsoever.

Edge rims 46 comprises locking lugs 51 and 52, the lugs being located substantially at transverse apices 43 and 44. Likewise, edge rim 47 comprises locking lugs 49 and 50, the lugs likewise being located substantially at transverse apices 43 and 44. By substantially is meant that the lugs, whatever their shape, need not be centered on the apices, what is required is that the distance from the outermost lug surface 55 of locking lug 49, that is, the surface that will be closest to the bottom surface of upper wedge-collar 20 in a properly assembled step, to the outermost edge of lug surface 55 of locking lug 51 and the distance from the outermost edge of lug surface 55 or locking lug 50 to the outermost edge of lug surface 55 of locking lug 52 are such that, when wedge-heart 40 is inserted through slot 21 of upper wedge-collar 20, each locking lug will contact lower surface 26 of upper wedge-collar 20 thus preventing the wedge-heart from passing completely through the slot in the upper wedge-collar. Such is most conveniently accomplished when the lugs are at the transverse apices of the diamond-shaped wedge-heart and also, when so located, the lugs have optimal strength compared to lugs situated otherwise wherein the surfaces 55 would have to be longer, and therefore weaker, to contact the upper wedge-collar bottom surface. Furthermore, while the locking lugs as shown in FIG. 4 are generally rectangular in shape, any suitable shape, many of which will become apparent to those skilled in the art based on the disclosure herein, may be used. All such shapes are within the scope of this invention.

Steps 10 can be constructed in numerous ways. For example, without limitation, they may be unitary molded polymeric constructs with appropriate slots and fastener holes that align with the slots and fastener bores in the upper and lower wedge collars. In fact, if desired, the upper wedge-collar may be molded with the rest of the step so that they form an integral unit. Alternatively, again without limitation, a step may consist of a rectangular metal frame with longitudinal members that generally describe the length of the step and cross-members that generally describe the width of the step, the cross-members being perpendicular to, and disposed at opposite ends of, the longitudinal members. The cross-members may be strengthened by additional cross-members disposed along the length of the longitudinal member or by diagonal members attached at one end to a longitudinal member and at the other end to a cross-member. In this construct, the end cross-members have slots and fastener holes that align with the wedge-collar slots and fastener extensions. A polymeric step piece is then molded around the frame. Other step constructs will likewise become apparent to those skilled in the art based on the disclosure herein; all such constructs are within the scope of this invention.

In a presently preferred embodiment of this invention steps 10 comprise longitudinal scaffold members 11 and 12 (FIG. 6) which can be made of any strong, durable break-resistant material but are typically metals such as steel, aluminum, iron and the like. Scaffold members 11 and 12 are entirely separate constructs that will eventually be held together by fasteners extending through the fastener bores of the upper and lower wedge collars and holes 13 in the scaffold members. The cross-sectional shape of the scaffold members may be any that confers sufficient strength on the members. Many such shapes are known to those skilled in the art; all are within the scope of this invention. Generally, a square or rectangular cross-section shape is used. The scaffold members can be solid or they can consist of an outer surface and an inner surface that describes a lumen, such as lumen 14 in FIG. 6, that runs the length of the member. This construct is presently preferred in order to render the finished rope ladder, which may consist of a large number of steps, as light as possible.

Figure 5:
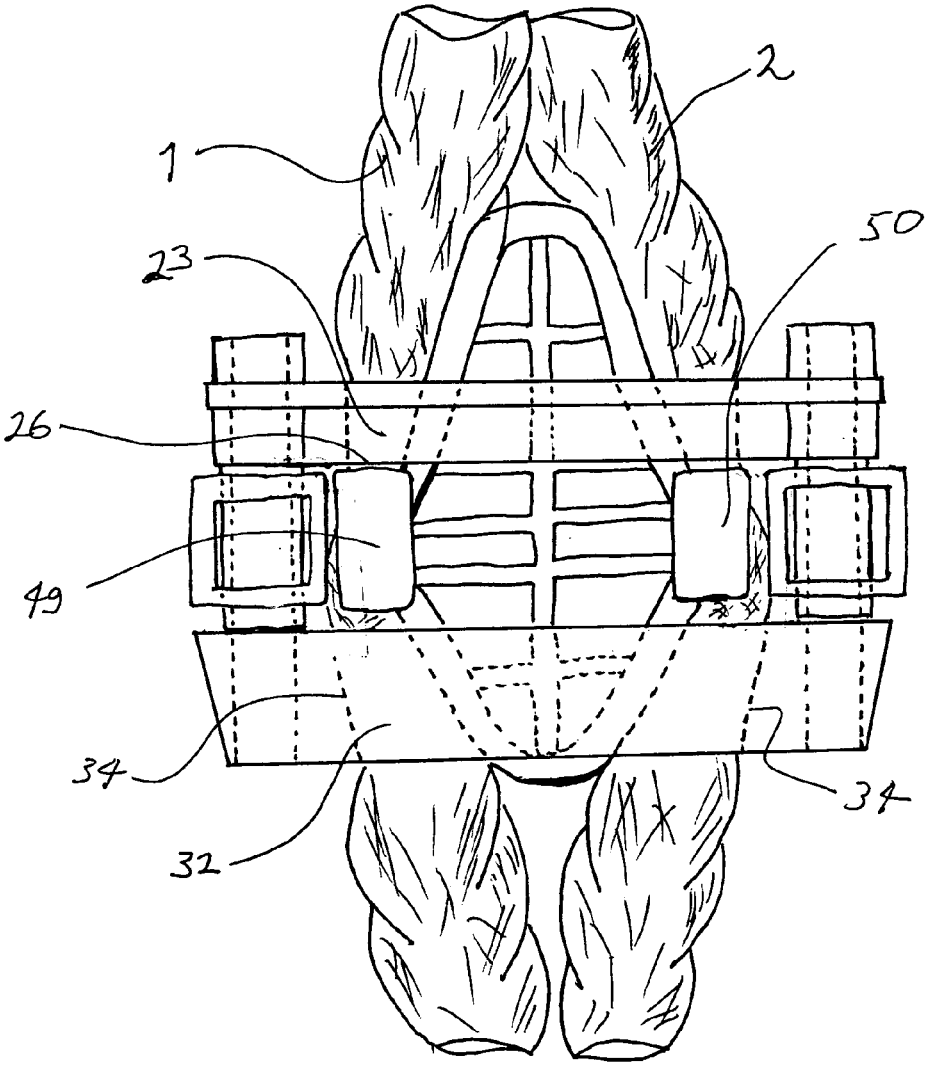
FIG. 5 is a representation of one end of an assembled step showing two ropes threaded through the slots in an upper wedge-collar and a lower wedge-collar with a wedge-heart inserted between the ropes such that the ropes are disposed in concave rope guides (grooves) on either side of the wedge-heart. The figure also shows how, when assembled, the wedge-heart cannot pass completely through the slot in the upper wedge-collar because the locking lugs on either side of the wedge-heart contact the bottom surface of the upper wedge-collar.

To assemble a rope ladder of this invention two pairs of two ropes, e.g., ropes 1 and 2 of FIGS. 1 and 5 are passed through slot 32 of lower wedge-collar 30, through slot 23 of upper-wedge collar 20 (the discussion that follows is directed to one end of a rope ladder step. It is understood that the same operations will be performed at the other end of the step with ropes 3 and 4). Fastener extensions 25 are inserted through holes 13 in scaffold members 11 and 12. A wedge-heart 40 is inserted between ropes 1 and 2 such that upper vertex 41 passes through slot 23 of upper wedge-collar 20 and lies a short distance above the plane of top surface 27 of upper wedge-collar 20 and lower apex 42 is inserted into slot 31 of lower wedge-collar 30 such that the apex extends a short distance beyond the plane of lower surface 36 of lower wedge-collar 30. Ropes 1 and 2 are set in concave rope-guide 45 on either side of wedge-heart 40 as shown in FIG. 5. Threaded bolts (not shown) are inserted through fastener bores 22 of upper wedge-collar 20, through fastener extensions 25, through holes 13 (FIG. 6) of scaffold members 11 and 12 and through fastener bores 31 of lower wedge-collar 30. Nuts are screwed onto the bolts and tightened. As the nuts are tightened, ropes 1 and 2 are compressed and frictionally secured between tapered, curved ribbed surface 34 of lower wedge-collar 30, ribbed rope guide 45 of wedge heart 40 and the smooth or ribbed surface of upper wedge-collar 20 as shown in FIG. 5. As a result of the tightening, locking lugs 49 and, 50 are brought in contact with bottom surface 26 of upper wedge-collar 20. When properly assembled with the correct size rope, that is rope having a diameter larger than the diameter of the opening created by rope guide 45 and tapered, ribbed surface 34 of lower wedge-collar 30 as well as the opening created by groove 45 and the vertical curved surface of upper wedge-collar 20 so that the rope is compressed in the openings when the step is fully assembled, the rope is held firmly and cannot slip. Even if a tremendous amount of downward pressure, which otherwise might be sufficient to cause wedge-heart 40 to slip through slot 23 of upper wedge-collar 20, is applied, locking lugs 49 and 50 will prevent such from occurring. It is in fact believed that the rope-securing device of this invention may be sufficiently slip-resistant that pressure on a step would be sufficient to cause the step to buckle and break before slippage of any of the ropes occurred.

Based on the disclosures herein those skilled in the art will recognize many changes that might be incorporated in the construction of the rope-securing device of this invention as well as widely different embodiments and applications thereof. All such changes, embodiments and applications are within the scope of this invention.

What is claimed:

1. A device for securing ropes to steps of a rope ladder, comprising:

a upper wedge-collar comprising:

a top surface having a length and a width;

a bottom surface substantially parallel to the top surface, having a length and a width substantially the same as the top surface, the top surface being coupled to the bottom surface by an edge surface;

an elongate slot extending through the upper wedge-collar from the top surface to the bottom surface, the slot being defined by two side-walls and two end walls, wherein:

the side walls and end walls are perpendicular to the top and bottom surfaces;

the side walls are substantially straight;

the end walls are curved, wherein the curve is simple or complex;

at least two fastener bores extending through the wedge-collar from the top surface to the bottom surface;

at least two fastener bore extensions, one for each fastener bore, coupled to the bottom surface such that a lumen through each extension aligns with each fastener bore;

a lower wedge-collar comprising:

a top surface having a length and a width;

a bottom surface substantially parallel to the top surface having a length and width substantially the same as the top surface, the top surface being coupled to the bottom surface by an edge surface;

an elongate slot extending through the lower wedge-collar from the top surface to the bottom surface, the slot being defined by two sidewalls and two end-walls, wherein:

the side walls are perpendicular to the top and bottom surfaces;

the end-walls are rounded and inwardly tapered from the top surface to the bottom surface such that the slot is larger at the top surface than it is at the bottom surface; and, a wedge-heart comprising:

a diamond-shaped first surface having an upper vertex, a lower vertex and two transverse vertices; and, a diamond-shaped second surface parallel to the first surface, the second surface being of substantially the same size and shape as the first surface and having an upper vertex, a lower vertex and two transverse vertices, wherein:

the second surface is coupled to the first surface by a concave edge surface comprising a first edge-rim and a second edge-rim, each of which extends the entire perimeter of the edge surface, wherein:

each edge-rim comprises two locking lugs, one located substantially at each transverse vertex, wherein:

the upper wedge-collar, the wedge-heart and the lower wedge collar are operationally coupled to one another.

2. The device of claim 1, wherein the end-walls of the lower wedge-collar comprise raised ribs substantially parallel to the top and bottom surfaces.

3. The device of claim 1, wherein the edge-surface of the wedge-heart comprises raised ribs substantially perpendicular to the first and second surfaces of the wedge-heart.

4. The device of claim 1, wherein:

the end-walls of the lower wedge-collar comprise raised ribs substantially parallel to the top and bottom surfaces; and, the edge-surface of the wedge-heart comprises raised ribs substantially perpendicular to the first and second surfaces of the wedge-heart.

5. The device of claim 1, wherein the upper wedge-collar, the lower wedge-collar and the wedge-heart are separate units.

6. The device of any one of claims 1, 2, 3, 4 or 5, wherein the upper wedge-collar, the lower wedge-collar and the wedge-heart each comprise a polymer, wherein the polymer that comprises each of the upper wedge-collar, the lower-wedge and the wedge-heart is the same as, or different from, the polymer of each of the others.

7. The device of claim 6, wherein the upper wedge-collar, the lower wedge-collar and the wedge-heart comprise the same polymer.

8. The device of claim 7, wherein the polymer comprises a moldable polymer that, after being molded into the shape of the upper wedge collar, the lower wedge collar or the wedge-heart becomes hard and tough.

9. The device of claim 8, wherein the polymer is nylon.

10. The device of claim 1, wherein the upper wedge collar can be formed as an integral part of a molded polymeric step.

11. A rope ladder step comprising the device of claim 1.

12. A rope ladder comprising a plurality of the rope ladder steps of claim 11.

* * * * *